United States Patent [19]

Berseth

[11] 4,194,101

[45] Mar. 18, 1980

[54] STARTING BLOCK SWITCH ASSEMBLY FOR TIMED SWIMMING EVENTS

[75] Inventor: Michel Berseth, La Neuveville, Switzerland

[73] Assignee: Societe Suisse pour l'Industrie Horlogere Management Services S.A., Switzerland

[21] Appl. No.: 908,866

[22] Filed: May 23, 1978

[30] Foreign Application Priority Data

Jun. 1, 1977 [CH] Switzerland ..... 6710/77

[51] Int. Cl.[2] ..... H01H 35/00; A63K 3/02

[52] U.S. Cl. ..... 200/52 R; 200/86.5; 272/4

[58] Field of Search ..... 200/52 R, 85 R, 86 R, 200/86 A, 86.5; 272/4, 71; 324/180, 178; 340/323 R

[56] References Cited

U.S. PATENT DOCUMENTS

| | | | |
|---|---|---|---|
| 2,058,211 | 10/1936 | Brown | 324/189 |
| 3,086,093 | 4/1963 | Barker | 200/85 R |
| 3,209,089 | 9/1965 | Weissburg | 200/86 R X |
| 3,263,168 | 7/1966 | Rainer | 200/86 R X |
| 3,544,989 | 12/1970 | MacCreadie | 340/323 R |
| 3,845,261 | 10/1974 | Blinkilde | 200/85 A |
| 3,916,214 | 10/1975 | Coble, Jr. et al. | 340/323 R X |
| 3,921,750 | 11/1975 | Shames | 200/86.5 X |

FOREIGN PATENT DOCUMENTS

| | | | |
|---|---|---|---|
| 503150 | 5/1951 | Belgium | 200/86.5 |
| 2425480 | 12/1975 | Fed. Rep. of Germany | 272/4 |

*Primary Examiner*—James R. Scott

*Attorney, Agent, or Firm*—Griffin, Branigan & Butler

[57] ABSTRACT

For detecting false starts and relaying failures in swimming competitions, a starting block is provided comprising a fixed base and a movable platform arranged to support a swimmer. The base and platform carry electrical contact terminals, the platform being suspended on the base by means of elastic shock absorbers which enable a displacement of the platform parallel to its swimmer support plane.

10 Claims, 3 Drawing Figures

STARTING BLOCK SWITCH ASSEMBLY FOR TIMED SWIMMING EVENTS

BACKGROUND OF THE INVENTION

The invention relates to a starting block for swimming competitions. This type of device is intended to determine the moment when the swimmer takes his departure and more precisely detect false starts or relaying failures.

Known starting blocks such as represented in FIG. 1 are formed of a platform 1 pivotally mounted as shown at 2 on a fixed base 3. Platform 1 may pivot about the articulation 2 under the effect of a force P representative of the weight of the swimmer and against the force of a spring 4 and may close electric contacts 5 the closure of which will indicate the presence of the swimmer on platform 1. As soon as the swimmer leaves the platform, spring 4 urges the platform against a stop 6 and contacts 5 open thereby signalling the departure of the swimmer.

According to current usage such as starting blocks are used only to detect relaying faults. When a swimmer who must be relayed completes his course through touching the touch pad indicating the end of his course the electronic measuring equipment indicates that the relaying swimmer continues to be on platform 1 so long as contacts 5 remain closed.

Although currently utilized, this type of starting block presents various and serious draw-backs.

The price of manufacture is very high in view of the fact that the pivot must be of an extremely resistant and very careful construction in order to be of long life and to maintain its qualities during numerous transports to and assemblies in different swimming pools.

A good electric contact switch is quite difficult to obtain, since it must not open and close merely under the effect of vibrations of the platform and must thus show a preliminary displacement and relatively large closing displacement. Such displacement of the platform is annoying for the swimmer if it should exceed 2–3 mm. The adjustment of this contact moreover is quite delicate and it is necessary to readjust it following each transportation or disassembly of the starting block.

The platform which must be very resistant is from this factor quite heavy and to overcome its inertia the return force of the spring must be quite considerable on the order of several decanewtons. Just prior to the departure of the swimmer there is produced a lightening phenomenon: the swimmer lightens the platform in order to gather himself together so as better to relax and to realize a good departure. During this phase the vertical component of the force exerted by the swimmer on the platform descends to a minimum which may be in the order of 2–3 decanewtons and is annulled at the instance of departure only a fraction of a second later (on the order of 1 tenth), after having passed once again to a maximum. The contacts may thus open and close before the effective departure of the swimmer, this phenomenon causing an uncertainty or error. On the other hand should the spring be weaker such undesired opening may be avoided, but in this case the considerable inertia of the platform and friction within the bearings may falsify the result, the swimmer having left the starting post well before the spring has been able to return the platform.

Such movement of the platform as well as slapping of the platform on its stop is moreover annoying for the swimmer.

SUMMARY OF THE INVENTION

To overcome the aforementioned difficulties the invention proposes to avoid use of the vertical component of the force exerted at the moment of departure by the swimmer on the platform and to use in place thereof, at least to a substantial extent the horizontal force component, that is to say the component parallel to the plane of the platform. Such platform is suspended on a support parallel to the platform by means of elastic shock absorbing means which enables a displacement of the platform approximately parallel to itself under the effect of the horizontal component of the impulse which the swimmer gives to the platform at the moment of his departure. A first electrical contact is mounted on the support and a second electrical contact is supported by the platform, the relative positions of the contacts being such that they make contact with each other only upon a displacement of the platform having a translational component parallel its plane of support.

This arrangement permits motion before or after contact of a small dimension without unforeseen vibrations and with easy adjustment, stable over a period of time.

DETAILED DESCRIPTION OF THE INVENTION

Figure 1:
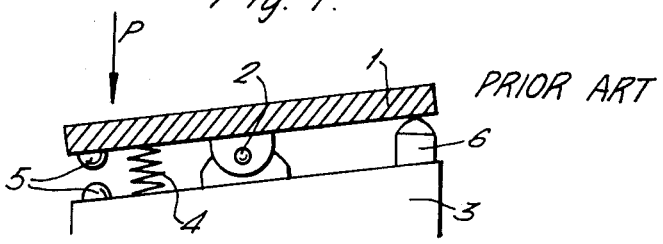
FIG. 1 shows a known construction of a starting block.
Figure 2:
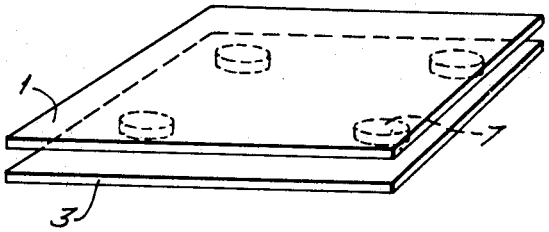
FIG. 2 shows in perspective the relative arrangement between the fixed support and the platform in accordance with the invention.

As schematically shown in FIG. 2, a platform 1 is suspended on a fixed support 3, the fixed support defining a plane inclined 0°–7.5° from the horizontal. Platform 1 is suspended parallel to support 3 by means of elastic shock absorbers 7. In order that the plane of platform 1 be well defined there are at least 3 or preferably 4 shock absorbers arranged in a square. The latter may, for example, comprise helical springs for which the end turns are supported respectively on the internal faces of support 3 and of platform 1, or may be buffers comprising an elastic material such as natural or synthetic rubber. Buffers which are currently sold under the name "silent-blocks" may be perfectly suitable for this utilization. The shock absorbers 7 are partially compressed under the effect of the vertical pressure representing the weight of a swimmer present on the platform 1 and provide an opposing force which is equal thereto, thus being self adjusting according to the requirements.

At the same time the shock absorbers 7, in view of their transversal elasticity, enable a displacement of platform 1 parallel to support 3; that is to say almost a horizontal translation under the effect of a force having a component in the plane of the platform. This is precisely that which is produced at the moment when a swimmer in the last phase of his departure movement gives an impetus upwards and forwards which causes him to leave platform 1. The displacement brought about by this component towards the forward or in the plane of the platform is utilized in order to close electric contacts 5 to therey determine the precise moment of the departure.

Figure 3:
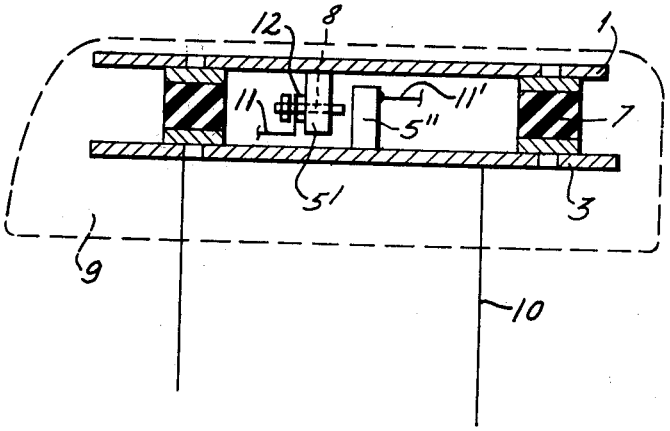
FIG. 3 shows a vertical section of the starting block and its several elements in accordance with the invention.

A practical example is shown in transverse section in FIG. 3. Support 3 is fixed to base 10. Platform 1 is suspended on support 3 by means of elastic buffers 7 for which the ends are fastened on the internal faces of support 3 and platform 1. The entire arrangement is covered by a protection hood 9 fixed to the platform 1. Support 3 may carry a stop member 5'' which at the same time functions as a conductive terminal or contact. The stop 5'' is not intended to inhibit vertical displacement of the platform 1 except in case of an excessive vertical load: during normal operation the weight of the swimmer is entirely carried by buffers 7. Platform 1 carries on its internal surface a conductive terminal 5' which, in rest position, is located at a distance from stop 5'' such that the horizontal component of the impetus from the swimmer jumping from the right towards the left brings it against stop 5'' and closes the electric contact in order to give the instant of departure. The normal distance between stop 5'' and terminal 5' is determined in a fashion such that the horizontal force which may correspond to a predetermined threshold will bring about closure of the contact 5'' with terminal 5', or, if the terminal 5' is provided with an adjustable contact 8 as illustrated in FIG. 3, closure of the contact 5'' with the contact 8. It will be understood that closure of contact 5' with 5'' or 8 will complete an electric circuit of a type well known in the art and generally indicated by lead wires 11 and 11'.

The normal impetus given through the departure of a swimmer corresponds to a minimum horizontal component on the order of 5–10 decanewtons. One may thus consider that the value of the threshold should be at least 5 decanewtons. In order to be able to realize a fine adjustment of the threshold the terminal 5' or stop 5'' may be provided with an adjustable contact for example in the form of a screw 8 having a lock-nut 12.

As soon as the feet of the swimmer leave the platform 1 or hood 9 the horizontal component ceases to be effective and, owing to the elastic characteristics of the buffers or springs 7, the platform 1 is thus brought almost instantaneously to its normal position with no friction and thus with no noise and practically without oscillation.

What is claimed is:

1. A starting block for timed swimming events comprising:

a fixed support;

a movable platform for supporting a swimmer;

elastic shock absorbing means disposed between said fixed support and said movable platform, said elastic shock absorbing means supporting said movable platform in a plane while permitting a displacement of the platform having a translational component parallel to said plane under an impetus imparted to the platform by a swimmer;

first contact means mounted on said fixed support; and, second contact means supported by said movable platform laterally of said first contact means whereby said first and second contact means make contact with each other only upon a displacement of said platform having a translational component parallel to said plane.

2. A starting block as claimed in claim 1 wherein said shock absorbing means comprises at least three elements.

3. A starting block as claimed in claim 1 wherein said shock absorbing means comprises four elements.

4. A starting block as claimed in claim 1 wherein said shock absorbing means comprises a plurality of helical springs, the end turns of which are respectively fixed to said fixed support and said movable platform.

5. A starting block as claimed in claim 1 wherein said shock absorbing means comprises buffers formed of an elastic material the ends of which are respectively anchored to said fixed support and said movable platform.

6. A starting block as claimed in claim 1 wherein said fixed support is provided with stop means for limiting displacement of said movable platform in a direction generally normal to said plane.

7. A starting block as claimed in claim 6 wherein said first contact means comprises a stop means for limiting displacement of said movable platform in a direction generally normal to said plane.

8. A starting block as claimed in claim 1 wherein contact between said first and second contact means closes an electrical circuit, the changes of state of which indicates the departure of a swimmer, the spring return force exerted by said shock absorbing means being such as to enable a change of state of said electric circuit when said translational component exceeds a predetermined threshold.

9. A starting block as claimed in claim 8 wherein one of said first and second contact means includes means for varying the relative position of said first and second contact means so as to permit adjustment of said threshold.

10. A starting block as claimed in claim 8 wherein at least one of said first and second contact means is positionally adjustable relative to the other contact means, said adjustment being set whereby a force on the order of 5–10 decanewtons applied by the swimmer in the sense of said translation component effects said change of state.

* * * * *